US011060171B2

(12) United States Patent
Beguinot et al.

(10) Patent No.: US 11,060,171 B2
(45) Date of Patent: Jul. 13, 2021

(54) WELDABLE COMPONENT OF STRUCTURAL STEEL AND METHOD OF MANUFACTURE

(75) Inventors: Jean Beguinot, Le Creusot (FR); Jean-Georges Brisson, Le Creusot (FR)

(73) Assignee: INDUSTEEL FRANCE, St. Denis (FR)

( * ) Notice: Subject to any disclaimer, the term of this patent is extended or adjusted under 35 U.S.C. 154(b) by 1858 days.

(21) Appl. No.: 10/535,174

(22) PCT Filed: Nov. 13, 2003

(86) PCT No.: PCT/FR03/03360

§ 371 (c)(1),
(2), (4) Date: Mar. 17, 2006

(87) PCT Pub. No.: WO2004/048630

PCT Pub. Date: Jun. 10, 2004

(65) Prior Publication Data

US 2007/0079912 A1 Apr. 12, 2007

(30) Foreign Application Priority Data

Nov. 19, 2002 (FR) ..... 02 14423

(51) Int. Cl.
*C21D 1/18* (2006.01)
*C22C 38/54* (2006.01)

(52) U.S. Cl.
CPC ..... *C22C 38/54* (2013.01); *C21D 1/18* (2013.01); *C21D 2211/001* (2013.01); *C21D 2211/002* (2013.01); *C21D 2211/008* (2013.01)

(58) Field of Classification Search
CPC ..... C21D 1/18; C22C 38/54
USPC ..... 148/660, 663, 330, 333
See application file for complete search history.

(56) References Cited

U.S. PATENT DOCUMENTS

| | | | | |
|---|---|---|---|---|
| 4,171,233 A | | 10/1979 | Vander Voort | |
| 4,673,433 A | * | 6/1987 | Roberts | C22C 38/06 148/547 |
| 5,855,845 A | * | 1/1999 | Beguinot | C22C 38/44 148/333 |
| 6,761,853 B2 | * | 7/2004 | Ishida | C22C 38/001 420/41 |

FOREIGN PATENT DOCUMENTS

| | | |
|---|---|---|
| JP | 60-5820 A | 1/1985 |
| JP | 5-320749 A | 12/1993 |
| JP | 6-299242 A | 10/1994 |
| WO | WO 96/22396 A | 7/1996 |

* cited by examiner

*Primary Examiner* — Jie Yang
(74) *Attorney, Agent, or Firm* — Sughrue Mion, PLLC

(57) ABSTRACT

The invention concerns steel building components whereof the chemical composition comprises, by weight: 0.40 %=C=0.50%, 0.50%=Si=1.50%, 0%=Mn=3%, 0%=Ni=5%, 0%=Cr=4%, 0%=Cu=1%, 0%=Mo+W/2=1.5%, 0.0005%=B=0.010%, N=0.025 %, Al≤0.9%, Si+Al=2.0%, optionally at least one element selected among V, Nb, Ta, S and Ca, in contents less than 0.3%, and among Ti and Zr in contents not more than 0.5%, the rest being iron and impurities resulting from the preparation, the aluminium, boron, titanium and nitrogen contents, expressed in thousandths of %, of said composition further satisfying the following relationship: $B=\frac{1}{3}\times K+0.5$, (1) with K=Min (1*; J*), I*=Max (0;1) and J*=Max(0;J), I=Min(N; N−0.29(Ti−5)), J=Min {N; 0.5 (N−0.52 Al+v(N−0.52 Al)$^2$+283)}, and whereof the structure is bainitic, martensitic or martensitic/bainitic and additionally comprises 3 to 20% of residual austenite. The invention also concerns a method for making said components.

5 Claims, No Drawings

WELDABLE COMPONENT OF STRUCTURAL STEEL AND METHOD OF MANUFACTURE

The present invention relates to weldable components of structural steel and to a method for their manufacture.

Structural steels must have a given level of mechanical characteristics in order to be suitable for the use which it is desired to make of them, and they must in particular exhibit a high degree of hardness. For that purpose, steels capable of being quenched are used, that is to say, steels in the case of which it is possible to obtain a martensitic or bainitic structure when they are cooled sufficiently rapidly and efficiently. A critical bainitic velocity is thus defined beyond which a bainitic, martensitic or martensitic-bainitic structure is obtained, as a function of the rate of cooling achieved.

The suitability of these steels for quenching depends on their content of quenching elements. As a general rule, the larger the amount in which these elements are present, the lower is the critical bainitic velocity.

Apart from their mechanical characteristics, structural steels must also have a good weldability. When a steel component is welded, the welding zone, which is also referred to as the Heat-Affected Zone or HAZ, is subjected to a very high temperature for a brief period and then to sudden cooling, which confer on that zone a high degree of hardness which may lead to cracking and may thus restrict the weldability of the steel.

In a conventional manner, the weldability of a steel can be estimated by calculating its "carbon equivalent" which is given by the following formula:

$$C_{eq}=(\%\ C+\%\ Mn/6+(\%\ Cr+(\%\ Mo+\%\ W/2)+\%\ V)/5+\%\ Ni/15)$$

To a first approximation, the lower its carbon equivalent, the more weldable is the steel. It will therefore be appreciated that the improvement in quenchability brought about by a greater content of quenching elements is to the detriment of weldability.

In order to improve the quenchability of these steels without degrading their weldability, grades micro-alloyed with boron have been developed, taking advantage of the fact that, in particular, the quenching efficiency of that element decreases when the austenitization temperature increases. Thus, the HAZ is less quenching than it would be in a grade of the same quenchability without boron, and it is thus possible to reduce the quenchability and hardness of this HAZ.

However, as the quenching effect of boron in the non-welded portion of the steel tends towards saturation for efficient contents of from 30 to 50 ppm, an additional improvement in the quenchability of the steel can be achieved only by adding quenching elements whose efficiency does not depend on the austenitization temperature, which automatically has an adverse effect on the weldability of these steels. Likewise, the improvement in weldability is brought about by a reduction in the content of quenching elements, which automatically reduces quenchability.

The object of the present invention is to overcome this disadvantage by proposing a structural steel having improved quenchability without a reduction in its weldability.

To that end, the first subject of the invention is a weldable component of structural steel whose chemical composition comprises, by weight:

$0.40\% \le C \le 0.50\%$
$0.50\% \le Si \le 1.50\%$ $0\% \le Mn \le 3\%$
$0\% \le Ni \le 5\%$
$0\% \le Cr \le 4\%$
$0\% \le Cu \le 1\%$
$0\% \le Mo+W/2 \le 1.5\%$
$0.0005\% \le B \le 0.010\%$
$N \le 0.025\%$
$Al \le 0.9\%$
$Si+Al \le 2.0\%$ optionally at least one element selected from V, Nb, Ta, S and Ca, at contents of less than 0.3%, and/or from Ti and Zr at contents of less than or equal to 0.5%, the remainder being iron and impurities resulting from the production operation, the contents of aluminium, boron, titanium and nitrogen, expressed in thousandths of %, of the composition also satisfying the following relationship:

$$B \ge \frac{1}{3} \times K + 0.5, \tag{1}$$

with $$K=\mathrm{Min}(I^*;J^*)$$

$$I^*=\mathrm{Max}(0;I)$$

and $$J^*=\mathrm{Max}(0;J)$$

$$I=\mathrm{Min}(N;N-0.29(Ti-5))$$

$$J=\mathrm{Min}(N;0.5(N-0.52Al+\sqrt{(N-0.52Al)^2+283})),$$

and whose structure is bainitic, martensitic or martensitic-bainitic and also comprises from 3 to 20% of residual austenite, preferably from 5 to 20% of residual austenite.

In a preferred embodiment, the chemical composition of the steel of the component according to the invention also satisfies the relationship:

$$1.1\%\ Mn+0.7\%\ Ni+0.6\%\ Cr+1.5(\%\ Mo+\%\ W/2) \ge 1, \text{ preferably } \ge 2 \tag{2}.$$

In another preferred embodiment, the chemical composition of the steel of the component according to the invention also satisfies the relationship:

$$\%\ Cr+3(\%\ Mo+\%\ W/2) \ge 1.8, \text{ preferably } \ge 2.0.$$

The second subject of the invention is a method for manufacturing a weldable steel component according to the invention, characterized in that:

- the component is austenitized by heating at a temperature of from $Ac_3$ to 1000° C., preferably from $Ac_3$ to 950° C., and it is then cooled to a temperature of less than or equal to 200° C. in such a manner that, at the core of the component, the cooling rate between 800° C. and 500° C. is greater than or equal to the critical bainitic velocity,
- optionally, tempering is effected at a temperature of less than or equal to $Ac_1$.

Between approximately 500° C. and ambient temperature and, in particular, between 500° C. and a temperature of less than or equal to 200° C., the cooling rate may optionally be slowed down, in particular in order to promote a phenomenon of auto-tempering and the retention of from 3% to 20% of residual austenite. Preferably, the cooling rate between 500° C. and a temperature of less than or equal to 200° C. is then from 0.07° C./s to 5° C./s; more preferably from 0.15° C./s to 2.5° C./s.

In a preferred embodiment, tempering is effected at a temperature of less than 300° C. for a period of time of less than 10 hours, at the end of the cooling operation to a temperature of less than or equal to 200° C.

In another preferred embodiment, the method according to the invention does not comprise tempering at the end of the operation of cooling the component to a temperature of less than or equal to 200° C.

In another preferred embodiment, the component subjected to the method according to the invention is a plate having a thickness of from 3 to 150 mm.

The third subject of the invention is a method for manufacturing a weldable steel plate according to the invention, whose thickness is from 3 mm to 150 mm, which method is characterized in that the plate is quenched, the cooling rate $V_R$ at the core of the plate between 800° C. and 500° C., expressed as ° C./hour, and the composition of the steel being such that:

$$1.1\%\ Mn+0.7\%\ Ni+0.6\%\ Cr+1.5(\%\ Mo+\%\ W/2)+\log V_R \geq 5.5,$$

and preferably ≥6, log being the decimal logarithm.

The present invention is based on the new finding that the addition of silicon at the contents indicated above enables the quenching effect of boron to be increased by from 30 to 50%. This synergy occurs without increasing the amount of boron added, while the silicon has no appreciable quenching effect in the absence of boron.

On the other hand, the addition of silicon does not affect the property of boron of seeing its quenchability decreased and then cancelled with increasing austenitization temperatures, as is the case in the HAZ.

It will therefore be appreciated that the use of silicon in the presence of boron enables the quenchability of the component to be further increased without the weldability thereof being adversely affected.

In addition, it has also been found that, owing to the improvement in the quenchability of these steel grades and while ensuring a minimum content of carbide-producing elements, which are represented, in particular, by chromium, molybdenum and tungsten, it was possible to manufacture these steels merely by carrying out tempering at a low temperature, or even by eliminating it.

The improvement in the quenchability enables the components to be cooled more slowly, while at the same time ensuring a substantially bainitic, martensitic or martensitic-bainitic structure. This slower cooling combined with a sufficient content of carbide-producing elements then permits the precipitation of fine chromium, molybdenum and/or tungsten carbides by a so-called auto-tempering phenomenon. This auto-tempering phenomenon is, in addition, greatly promoted by the slowing of the cooling rate below 500° C. Likewise, this slowing also promotes the retention of austenite, preferably in a proportion of from 3% to 20%. The method of manufacture is therefore simplified, while at the same time the mechanical characteristics of the steel, which no longer undergoes major softening due to tempering at high temperature, which is the normal practice are improved. It does, however, remain possible to carry out such tempering at the usual temperatures, that is to say, temperatures of less than or equal to Act.

The invention will now be described in more detail but in a non-limiting manner.

The steel of the component according to the invention contains, by weight:

- more than 0.40% of carbon, in order to enable excellent mechanical characteristics to be obtained, but less than 0.50% in order to obtain good weldability, good cuttability, a good suitability for bending and satisfactory toughness;
- more than 0.50%, preferably more than 0.75%, and particularly preferably more than 0.85% by weight, of silicon in order to obtain synergy with the boron, but less than 1.50% by weight in order not to embrittle the steel;
- more than 0.0005%, preferably more than 0.001% of boron in order to adjust the quenchability, but less than 0.010% by weight in order to avoid too high a content of boron nitrides which are detrimental to the mechanical characteristics of the steel;
- less than 0.025%, and preferably less than 0.015% of nitrogen, the content obtained being a function of the method used to produce the steel,
- from 0% to 3% and preferably from 0.3% to 1.8% of manganese, from 0% to 5% and preferably from 0% to 2% of nickel, from 0% to 4% of chromium, from 0 to 1% of copper, the sum of the content of molybdenum and half the content of tungsten being less than 1.50% in order to obtain a principally bainitic, martensitic or martensitic-bainitic structure, the chromium, molybdenum and tungsten having, in addition, the advantage of permitting the formation of carbides favourable to mechanical strength and resistance to wear, as indicated above; in addition, the sum % Cr+3(% Mo+% W/2) is preferably greater than 1.8%, and, particularly preferably, greater than 2.0% in order optionally to be able to limit tempering to 300° C., or even to eliminate it;
- less than 0.9% of aluminium, which, beyond that amount, would be detrimental to castability (clogging of the casting ducts by inclusions). The cumulative content of aluminium and silicon must also be less than 2.0% in order to limit the risk of tearing during rolling;
- optionally at least one element selected from V, Nb, Ta, S and Ca, at contents of less than 0.3%, and/or from Ti and Zr at contents of less than or equal to 0.5%. The addition of V, Nb, Ta, Ti, Zr permits precipitation-hardening without having an excessively adverse effect on weldability. The titanium, zirconium and aluminium can be used to fix the nitrogen present in the steel, which protects the boron, it being possible to replace all or some of the titanium by twice the weight of Zr. The sulphur and the calcium improve the machinability of the grade;
- the contents of aluminium, boron, titanium and nitrogen, expressed in thousandths of %, of the composition also satisfying the following relationship $$B \geq \frac{1}{3} \times K + 0.5, \quad (1)$$

with $K = \mathrm{Min}(I^*; J^*)$ $I^* = \mathrm{Max}(0; I)$ and $J^* = \mathrm{Max}(0; J)$ $$I=\mathrm{Min}(N;N-0.29(Ti-5))$$

$$J=\mathrm{Min}(N;0.5(N-0.52Al+\sqrt{(N-0.52Al)^2+283})),$$

the remainder being iron and impurities resulting from the production operation.

In order to manufacture a weldable component, a steel according to the invention is produced and is cast in the form of a semi-finished product which is then formed by plastic deformation at high temperature, for example by rolling or by forging. The component so obtained is then austenitized by heating at a temperature above $Ac_3$ but less than 1000° C., and preferably less than 950° C., and it is then cooled to ambient temperature in such a manner that, at the core of the component, the cooling rate between 800° C. and 500° C. is greater than the critical bainitic velocity. The temperature of austenitization is limited to 1000° C. because, beyond that temperature, the quenching effect of the boron becomes too weak.

However, it is also possible to obtain the component by direct cooling in the heat of the forming operation (without re-austenitization) and in that case, even if the heating before forming exceeds 1000° C., while remaining less than 1300° C., the boron preserves its effect.

In order to cool the component to ambient temperature from the temperature of austenitization, it is possible to use any of the known quenching methods (air, oil, water) as long as the rate of cooling remains higher than the critical bainitic velocity.

The component is then optionally subjected to conventional tempering at a temperature of less than or equal to $Ac_1$, but it is preferred to limit the temperature to 300° C., or even to eliminate this step. The absence of tempering may optionally be compensated for by a phenomenon of auto-tempering. This phenomenon is promoted, in particular, by permitting a cooling rate at low temperature (that is to say, below approximately 500° C.) which is preferably from 0.07° C./s to 5° C./s; more preferably from 0.15° C./s to 2.5° C./s.

To that end, any of the known quenching means may be used, provided that they are, if necessary, controlled. Thus, it would be possible to use, for example, water quenching if the rate of cooling is slowed down when the temperature of the component falls below 500° C., which could be effected, in particular, by removing the component from the water in order to finish the quenching operation in the air.

A weldable component, and especially a weldable plate, constituted by steel having a bainitic, martensitic or martensitic-bainitic core structure, comprising from 3 to 20% of residual austenite, is thus obtained.

The presence of residual austenite is of particular interest with regard to the behaviour of the steel when welded. With a view to limiting the risk of cracking during welding, and in addition to the above-mentioned reduction in the quenchability of the HAZ, the presence of residual austenite in the basic metal, in the vicinity of the HAZ, permits the fixing of a portion of the dissolved hydrogen which may possibly have been introduced by the welding operation and which, if not fixed in this manner, would increase the risk of cracking.

By way of example, bars were manufactured with steels 1 and 2 according to the invention and with steels A and B according to the prior art, the compositions of which are, in thousandths of % by weight, and with the exception of iron:

| | C | Si | B | Mn | Ni | Cr | Mo | W | V | Nb | Ti | Al | N |
|---|---|---|---|---|---|---|---|---|---|---|---|---|---|
| 1 | 415 | 870 | 2 | 1150 | 510 | 1110 | 450 | — | — | — | — | 55 | 6 |
| A | 420 | 315 | 3 | 1150 | 520 | 1130 | 460 | — | — | — | — | 52 | 5 |
| 2 | 450 | 830 | 3 | 715 | 1410 | 1450 | 410 | 230 | 65 | 38 | 32 | 25 | 6 |
| B | 460 | 280 | 3 | 720 | 1430 | 1470 | 425 | 240 | 63 | 42 | 31 | 27 | 6 |

When the bars had been forged, the quenchability of the four steels was evaluated by dilatometry. Here the interest lay, by way of example, in the martensitic quenchability and therefore in the critical martensitic velocity V1 after austenitization at 900° C. for 15 minutes.

This velocity V1 is used to deduce the maximum plate thicknesses that can be obtained while preserving a substantially martensitic core structure which also comprises at least 3% of residual austenite. These thicknesses were determined in the case of air quenching (A), oil quenching (H) and water quenching (E).

Finally, the weldability of the two steels was estimated by calculating their percentage carbon equivalent according to the formula:

$$C_{eq}=(\%\ C+\%\ Mn/6+(\%\ Cr+(\%\ Mo+\%\ W/2)+\%\ V)/5+\%\ Ni/15)$$

The characteristics of bars L1 and L2 according to the invention and of bars LA and LB, given by way of comparison, are:

| | V1 | Max. thickness (mm) | | | $C_{eq}$ |
|---|---|---|---|---|---|
| Bar | (° C./h) | A | H | E | (%) |
| L1 | 8 800 | 7 | 60 | 100 | 0.95 |
| LA | 15 000 | 4 | 40 | 75 | 0.91 |
| L2 | 5 000 | 13 | 80 | 120 | 1.07 |
| LB | 8 200 | 8 | 55 | 85 | 1.09 |

It will be appreciated that the critical martensitic velocities of the components according to the invention are markedly lower than the corresponding velocities of the steel bars of the prior art, which means that their quenchability has been substantially improved while at the same time their weldability is unchanged.

The improvement in quenchability thus enables components having a core-quenched structure to be manufactured under less drastic cooling conditions than those of the prior art and/or at greater maximum thicknesses.

The invention claimed is:

1. A weldable component of structural steel, characterized in that its chemical composition consists of, by weight:

0.40%≤C≤0.45%
0.75%≤Si≤1.50%
0.3%≤Mn≤3%
0%≤Ni≤5%
1.11%≤Cr≤4%
0%≤Cu≤1%
0.410%≤Mo≤1.5%
0.410%≤Mo+W/2≤1.5%
0.038%≤Nb≤0.3%

0.0005%≤B≤0.010%

0.006%≤N≤0.025%

Al≤0.9%

Si+Al≤2.0% optionally at least one element selected from V, Ca, and Ta, at contents of less than 0.3%, and/or from Ti and/or Zr at contents of less than or equal to 0.5%, the remainder being iron and impurities resulting from the production operation, the contents of aluminum, boron, titanium and nitrogen, expressed in thousandths of %, of the composition also satisfying the following relationship:

$$B \geq \frac{1}{3} \times K + 0.5, \quad (1)$$

with $$K = \mathrm{Min}(I^*; J^*)$$

$$I^* = \mathrm{Max}(0; I)$$

and $$J^* = \mathrm{Max}(0; J)$$

$$I = \mathrm{Min}(N; N - 0.29(Ti - 5))$$

$$J = \mathrm{Min}(N; 0.5(N - 0.52Al + \sqrt{(N - 0.52Al)^2 + 283})),$$

and whose structure is bainitic or martensitic-bainitic and also comprises from 3 to 20% of residual austenite, and wherein the amounts of Si and B improve the quenchability of the steel without deteriorating its weldability.

2. Steel component according to claim 1, characterized in that its chemical composition also satisfies the following relationship:

$$1.1\%\ Mn + 0.7\%\ Ni + 0.6\%\ Cr + 1.5(\%\ Mo + \%\ W/2) \geq 1 \quad (2).$$

3. Steel component according to claim 2, characterized in that its chemical composition also satisfies the following relationship:

$$1.1\%\ Mn + 0.7\%\ Ni + 0.6\%\ Cr + 1.5(\%\ Mo + \%\ W/2) \geq 2 \quad (3).$$

4. Steel component according to claim 1, characterized in that its chemical composition also satisfies the following relationship:

$$\%\ Cr + 3(\%\ Mo + \%\ W/2) \geq 1.8 \quad (4).$$

5. Steel component according to claim 4, characterized in that its chemical composition also satisfies the following relationship:

$$\%\ Cr + 3(\%\ Mo + \%\ W/2) \geq 2.0 \quad (5).$$

* * * * *